US011898547B2

(12) United States Patent
Yoshii et al.

(10) Patent No.: US 11,898,547 B2
(45) Date of Patent: Feb. 13, 2024

(54) PUMP AND FLUID SUPPLY DEVICE

(71) Applicant: MINEBEA MITSUMI INC., Nagano (JP)

(72) Inventors: Yuta Yoshii, Tokyo (JP); Chikara Sekiguchi, Tokyo (JP); Shigenori Inamoto, Tokyo (JP); Yuki Takahashi, Tokyo (JP); Daisuke Kodama, Tokyo (JP); Kenta Ueda, Tokyo (JP); Daisuke Kurita, Nagano (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days.

(21) Appl. No.: 17/656,186

(22) Filed: Mar. 23, 2022

(65) Prior Publication Data

US 2022/0316464 A1 Oct. 6, 2022

(30) Foreign Application Priority Data

Mar. 30, 2021 (JP) ..... 2021-058522

(51) Int. Cl.
*F04B 43/02* (2006.01)

(52) U.S. Cl.
CPC ..... *F04B 43/02* (2013.01)

(58) Field of Classification Search
CPC ... A61B 5/02141; A61B 5/022; F04B 35/045; F04B 43/02; F04B 43/025; F04B 43/04; F04B 45/04; F04B 45/043; F04B 45/047
See application file for complete search history.

(56) References Cited

U.S. PATENT DOCUMENTS 3,784,334 A * 1/1974 Hilgert ..... H02K 33/12 310/22
2012/0070323 A1* 3/2012 Felber ..... A61M 1/80 417/413.1
2014/0037475 A1* 2/2014 Ishii ..... F04B 43/04 417/413.1

(Continued)

FOREIGN PATENT DOCUMENTS

CN 110259674 A * 9/2019 ..... F04B 45/047
EP 2365220 A1 * 9/2011 ..... F04B 1/00

(Continued)

OTHER PUBLICATIONS

CN110259674A_t machine translation thereof (Year: 2019).*

(Continued)

*Primary Examiner* — Kenneth Bomberg
*Assistant Examiner* — Matthew Wiblin
(74) *Attorney, Agent, or Firm* — McCoy Russell LLP

(57) ABSTRACT

A pump contains a sealed chamber, a movable wall for changing a volume of the sealed chamber, and a vibration actuator which can be electromagnetically driven for displacing the movable wall to discharge fluid in the sealed chamber to an outside of the sealed chamber. Further, three axes perpendicular to each other are respectively defined as an X axis, a Y axis, and a Z axis. When a direction along the X axis is defined as an X axis direction, a direction along the Y axis is defined as a Y axis direction, and a direction along the Z axis direction is defined as a Z axis direction, an outer shape of the pump is a concave shape in a planar view from the Y axis direction.

5 Claims, 17 Drawing Sheets

(56) References Cited

U.S. PATENT DOCUMENTS

2018/0301969 A1 10/2018 Takahashi et al.

FOREIGN PATENT DOCUMENTS

| | | | | | |
|---|---|---|---|---|---|
| GB | 2356024 | A | * | 5/2001 | ..... F04B 35/045 |
| JP | S5139813 | U | | 3/1976 | |
| JP | 2019075966 | A | | 5/2019 | |
| JP | 2020006344 | A | | 1/2020 | |
| JP | 2020041469 | A | | 3/2020 | |

OTHER PUBLICATIONS

European Patent Office, Extended European Search Report Issued in Application No. 22164515.3, dated Jun. 29, 2022, Germany, 8 pages.

* cited by examiner

PUMP AND FLUID SUPPLY DEVICE

CROSS-REFERENCE TO RELATED APPLICATION

The present application claims priority to Japanese Patent Application No. 2021-058522, filed on Mar. 30, 2021. The entire contents of the above-listed application are hereby incorporated by reference for all purposes.

TECHNICAL FIELD

The present disclosure relates to a pump and a fluid supply device.

BACKGROUND

For example, patent document 1 discloses a cylindrical pump.

RELATED ART DOCUMENT

Patent Document

Patent Document 1: JP 2020-041469A

SUMMARY

Problem to be Solved by the Disclosure

However, if a cylindrical pump 50 is provided in a device 10 having a concave flat curved shape designed so as to be along a surface (skin) of a human body such as a wearable terminal (for example, a smartwatch, a sphygmomanometer or the like) as shown in FIG. 1, the pump 50 interferes with the device 10. Thus, even if there is a sufficient space in the device 10, there is a case where the pump 50 cannot be provided in the device 10. In this case, in order to provide the pump 50 in the device 10, it is required to reduce a size of the pump 50 as indicated in FIG. 1 by a two-dot chain line or to increase a size of the device 10 as indicated in FIG. 1 by a one-dot chain line. In the former case where the pump 50 is downsized, there is a problem that it is difficult to reduce the size of the pump 50 due to technical problems. In the latter case where the device 10 is upsized, there is a problem that the device 10 becomes large.

The present disclosure has been made in view of the above-described problem of the conventional art. Particularly, it is an object of the present disclosure to provide a pump having a shape easy to be provided in a device having a concave curved shape and a fluid supply device in which the pump is provided.

Means for Solving the Problems

The above object is achieved by the present disclosures defined in the following (1) to (10).

(1) A pump, comprising:

a sealed chamber;

a movable wall for changing a volume of the sealed chamber; and a vibration actuator which can be electromagnetically driven for displacing the movable wall to discharge fluid in the sealed chamber to an outside of the sealed chamber, wherein three axes perpendicular to each other are respectively defined as an X axis, a Y axis and a Z axis, and wherein when a direction along the X axis is defined as an X axis direction, a direction along the Y axis is defined as a Y axis direction, and a direction along the Z axis direction is defined as a Z axis direction, an outer shape of the pump is a concave shape in a planar view from the Y axis direction.

(2) The pump according to the above (1), wherein the outer shape of the pump is an arc shape in the planar view from the Y axis direction.

(3) The pump according to the above (1), wherein the outer shape of the pump is a stepped shape having a step between a central portion of the pump and each of end portions respectively located on both sides of the pump 5 in the planar view from the Y axis direction.

(4) The pump according to any one of (1) to (3), wherein the outer shape of the pump has a flat shape whose length in the Z axis direction is shorter than each of a length in the X axis direction and a length in the Y axis direction.

(5) The pump according to any one of the above (1) to (4), wherein the vibration actuator has a movable body which can perform reciprocating vibration in the Y axis direction to displace the movable wall.

(6) The pump according to any one of the above (1) to (4), wherein the vibration actuator has a movable body which can perform reciprocating vibration in the X axis direction to displace the movable wall.

(7) The pump according to any one of the above (1) to (4), wherein the vibration actuator has a movable body which can perform reciprocating vibration around the Z axis to displace the movable wall.

(8) The pump according to any one of the above (1) to (7), wherein the outer shape of the pump is a concave shape in a planar view from the X axis direction.

(9) A fluid supply device, comprising:

the pump defined by any one of the above (1) to (8).

(10) The fluid supply device according to the above (9), wherein the fluid supply device is used with being attached to a human body, and wherein the pump is provided in a portion having a curved shape along the human body.

Effect of the Disclosure

In the pump of the present disclosure, a housing is curved or bent in the concave shape in the planar view from the Y axis direction. This configuration makes it easy to provide the pump in the fluid supply device which has the concave curved shape designed so as to be along the surface (skin) of the human body such as the wearable terminal (for example, the smartwatch, the sphygmomanometer or the like).

DETAILED DESCRIPTION

Hereinafter, a pump and a fluid supply device of the present disclosure will be described in detail with reference to certain embodiments shown in the accompanying drawings. In the following description, it is noted that three axes perpendicular to each other are respectively defined as an X axis, a Y axis, and a Z axis. Further, a direction along the X axis is also referred to as "X axis direction", a direction along the Y axis is also referred to as "Y axis direction", and a direction along the Z axis is also referred to as "Z axis direction". An arrowed side in each of the axes is also referred to as "positive side" and the opposite side of the arrowed side is also referred to as "negative side". The positive side of the Z axis direction is also referred to as "upper or upper side" and the negative side is also referred to as "lower or lower side".

First Embodiment

Figure 1:
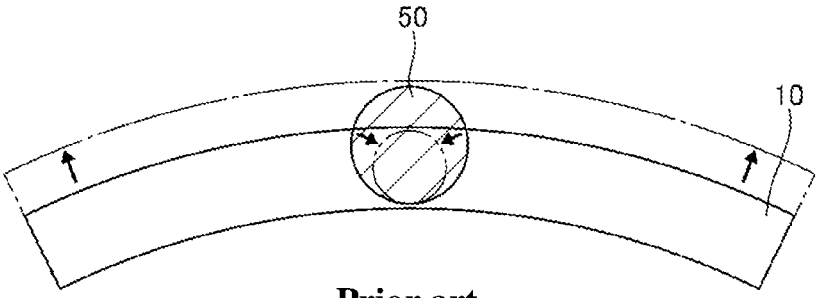
Prior art Fig. 1
FIG. 1 is a schematic diagram for explaining a problem of a prior art.
Figure 2:
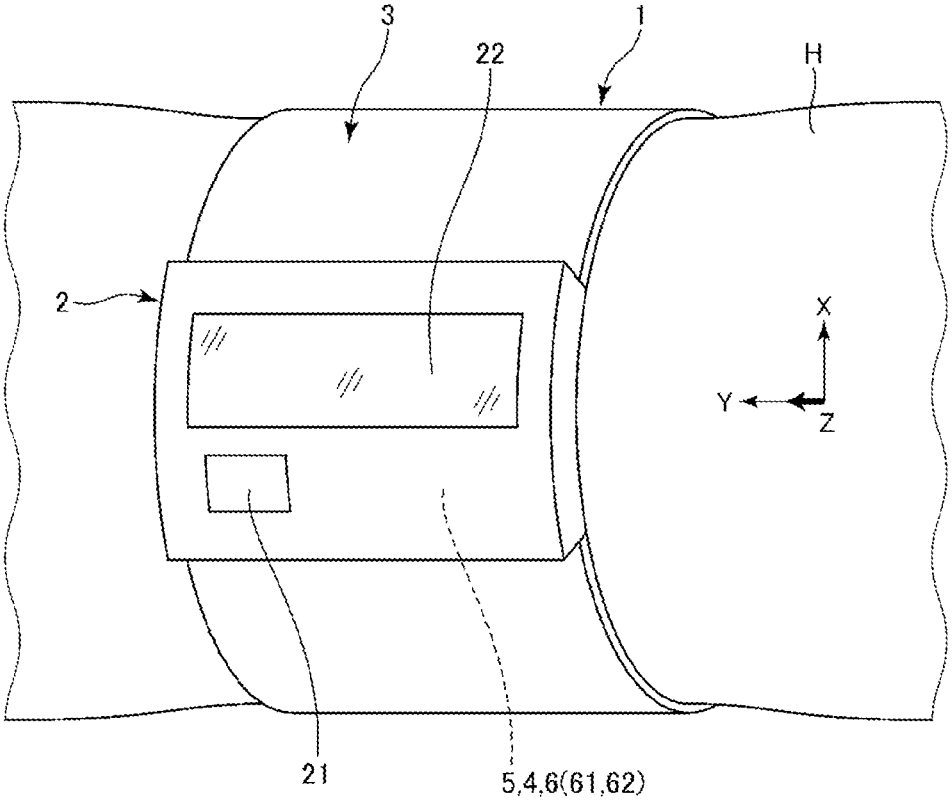
FIG. 2 is a perspective view showing an electronic sphygmomanometer according to a first embodiment of the present disclosure.
Figure 3:
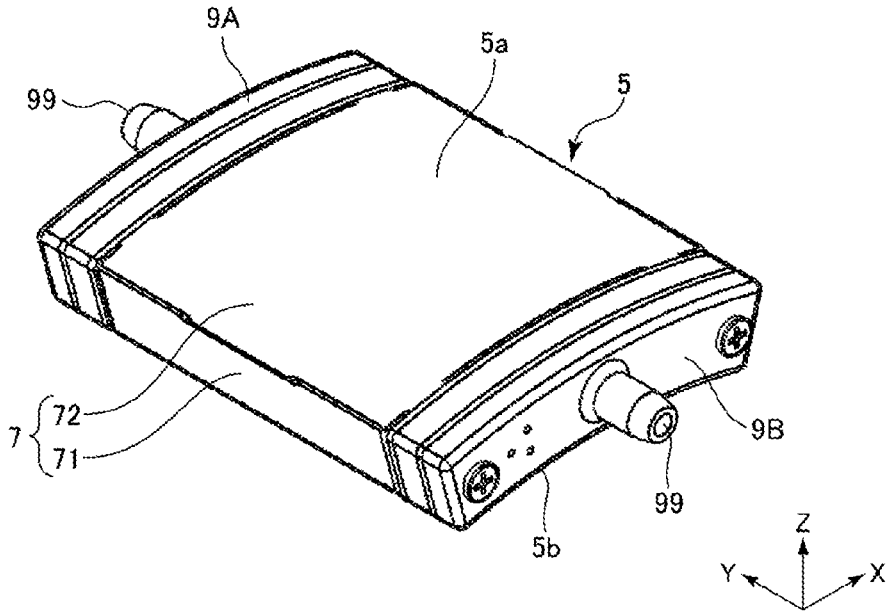
FIG. 3 is a perspective view showing a pump provided in the electronic sphygmomanometer.
Figure 4:
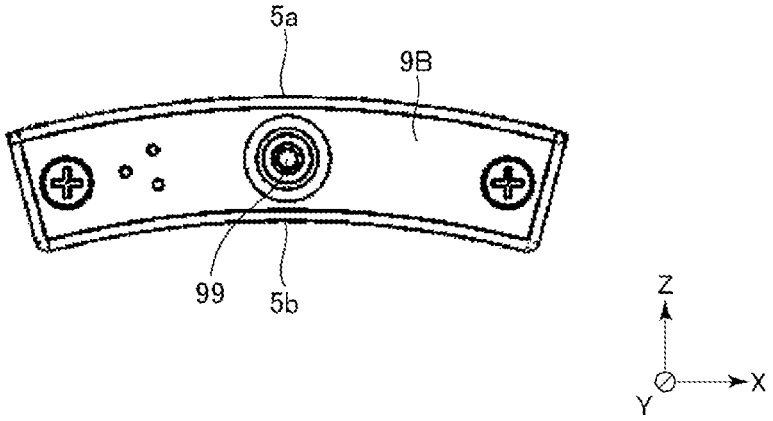
FIG. 4 is a planar view of the pump viewed from the Y axis direction.
Figure 5:
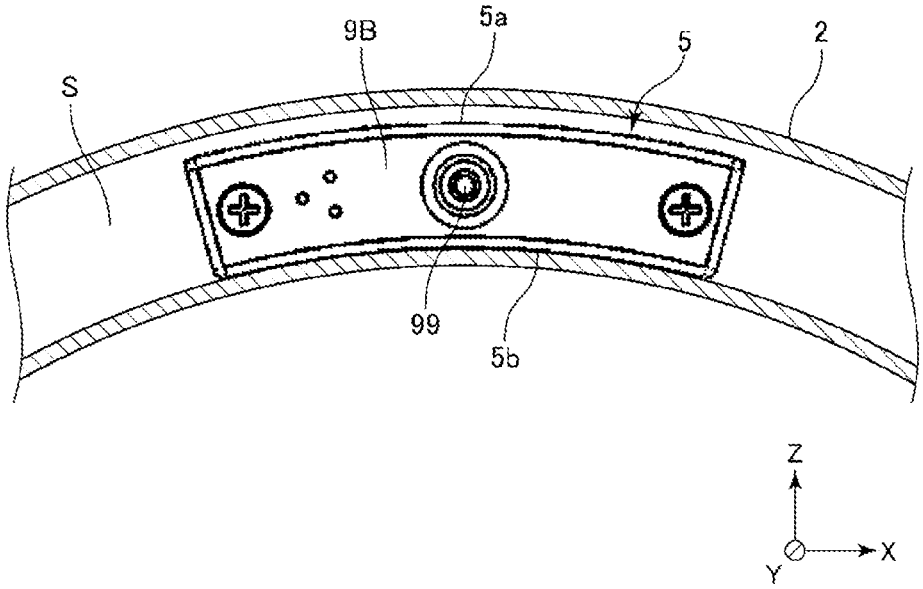
FIG. 5 is a cross-sectional view showing a state in which the pump is provided in the electronic sphygmomanometer.
Figure 6:
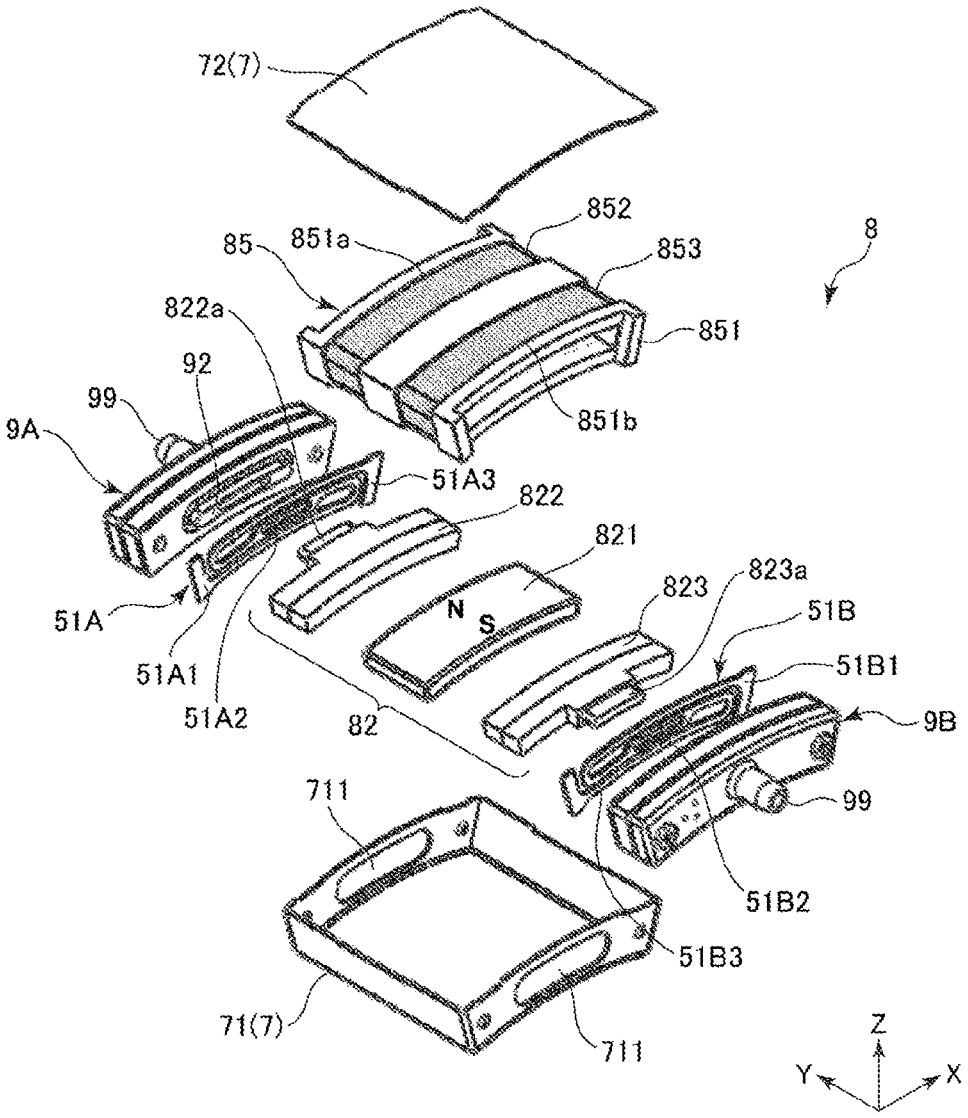
FIG. 6 is an exploded perspective view of the pump.
Figure 7:
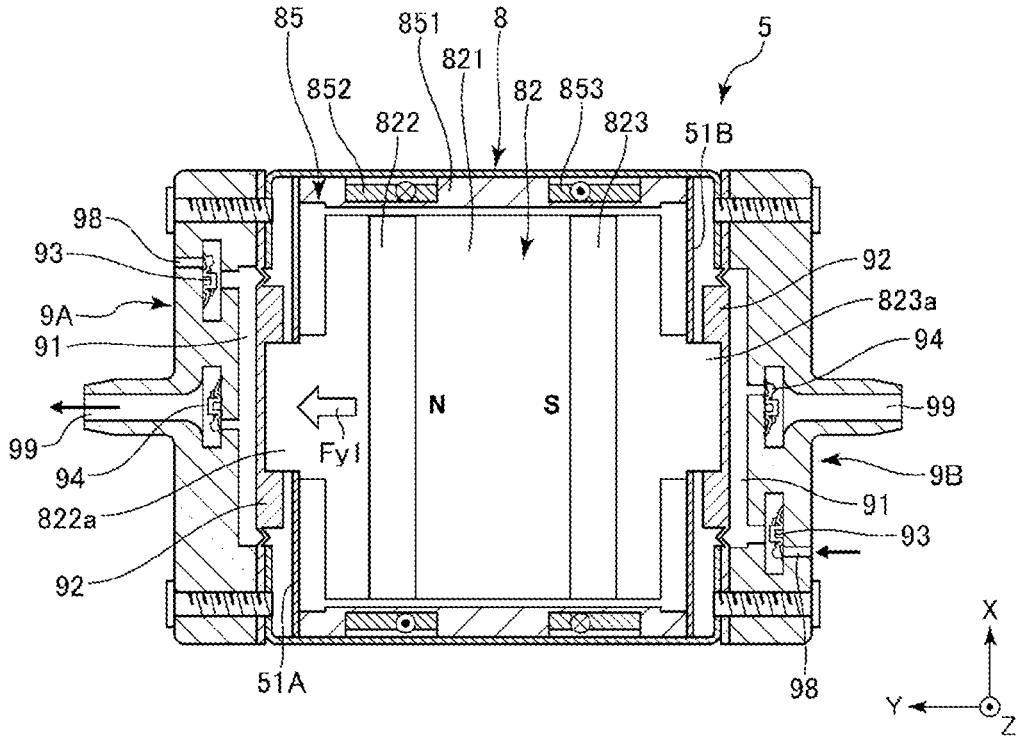
FIG. 7 is a cross-sectional view showing a driving state of the pump.
Figure 8:
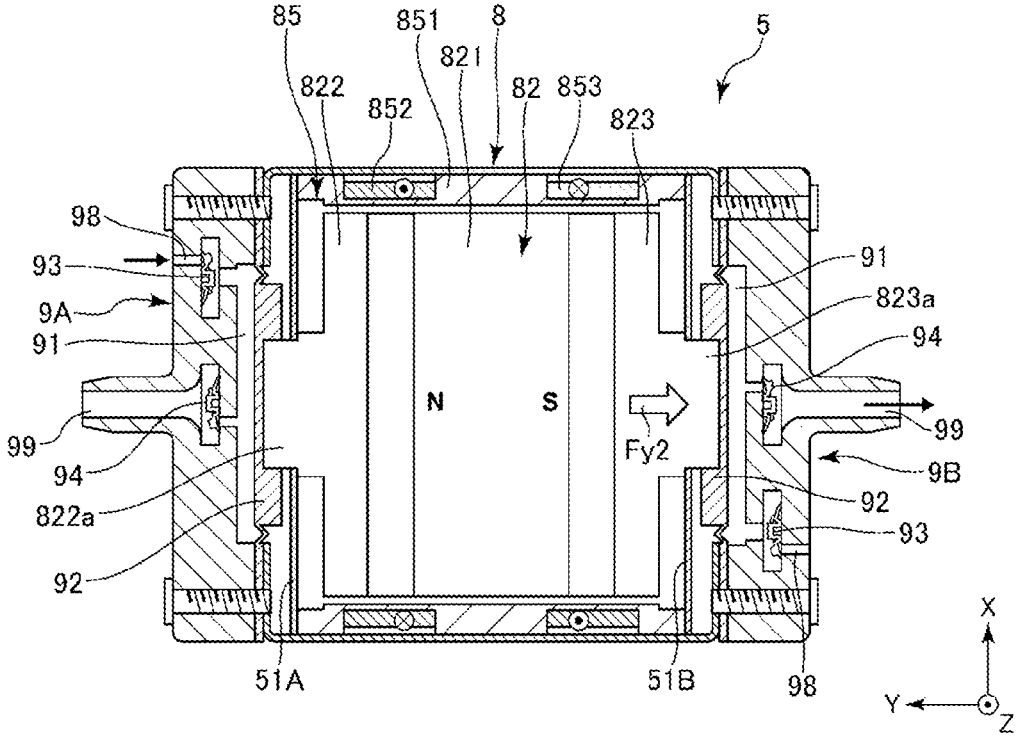
FIG. 8 is another cross-sectional view showing another driving state of the pump.

FIG. 2 is a perspective view showing an electronic sphygmomanometer according to a first embodiment of the present disclosure. FIG. 3 is a perspective view showing a pump provided in the electronic sphygmomanometer. FIG. 4 is a planar view of the pump viewed from the Y axis direction. FIG. 5 is a cross-sectional view showing a state in which the pump is provided in the electronic sphygmomanometer. FIG. 6 is an exploded perspective view of the pump. FIGS. 7 and 8 are cross-sectional views respectively showing driving states of the pump.

FIG. 2 shows an electronic sphygmomanometer 1 serving as a fluid supply device. The electronic sphygmomanometer 1 includes a main body 2 and a cuff 3 connected to the main body 2. The cuff 3 is attached to a measurement target part H such as an arm of a user. The cuff 3 has a bladder (not shown) provided therein. The bladder is inflated when fluid is supplied from the main body 2 into the bladder to compress the measurement target part H. The main body 2 measures pressure in the cuff 3 to calculate a blood pressure value of the user based on a measurement result. The main body 2 and the cuff 3 are integrally provided in the electronic sphygmomanometer 1. Thus, the main body 2 is also attached to the measurement target part H together with the cuff 3. The fluid to be supplied from the main body 2 into the cuff 3 is not particularly limited. Although the fluid may be liquid or gas, in some embodiments, the fluid is the gas. For convenience of explanation, the following description will be given with assuming that the fluid is air.

When blood pressure is measured according to the general oscillometric method, the following procedure is performed. First, the cuff 3 is wound onto the measurement target part H of the user. At the time of measuring the blood pressure, the air is supplied from the main body 2 into the cuff 3 to make the pressure in the cuff 3 (referred to as "cuff pressure") higher than a maximum blood pressure of the user. After that, the pressure in the cuff 3 is gradually reduced. During this process, the main body 2 detects the pressure in the cuff 3 to obtain a variation of an arterial volume occurring in an artery of the measurement target part H as a pulse wave signal. The maximum blood pressure (systolic blood pressure) and a minimum blood pressure (diastolic blood pressure) of the user are calculated based on a change of an amplitude of the pulse wave signal caused by a change of the cuff pressure. More specifically, the maximum blood pressure (systolic blood pressure) and the minimum blood pressure (diastolic blood pressure) of the user are mainly calculated based on a rising edge and a falling edge of the pulse wave signal. However, the blood pressure measurement method is not particularly limited thereto. For example, it is possible to use the Riva-Rocci Korotkoff method commonly used in conjunction with the oscillometric method.

As shown in FIG. 2, the main body 2 has a concave shape curved along a surface of the measurement target part H so as to fit the measurement target part H. Specifically, the main body 2 has an arc shape curved in a substantially arc shape around the Y axis in the planar view from the Y axis direction. The main body 2 (the portion along the human body) includes a pump 5 for supplying the air into the cuff 3, a pressure sensor 4 for detecting the pressure in the cuff 3 and a control device 6 for controlling drive of each part. The pump 5, the pressure sensor 4 and the control device 6 are provided in the main body 2. Further, a button 21 for starting the blood pressure measurement, a display 22 for displaying a result of the measurement and the like are provided on a surface of the main body 2. However, a configuration of the electronic sphygmomanometer 1 is not particularly limited.

Pump 5

An outer shape (a contour shape) of the pump 5 is a flat shape whose length in the Z axis direction is shorter than each of a length in the X axis direction and a length in the Y axis direction when the Z axis direction is defined as a thickness direction of the pump 5 as shown in FIGS. 3 and 4. With this configuration, the pump 5 becomes thin. Further, the outer shape (the contour shape) of the pump 5 is a concave shape along the shape of the main body 2. Specifically, the outer shape of the pump 5 is a flat plate-like shape and a concave shape curved in a substantially arc shape around the Y axis in the planar view from the Y axis direction.

Namely, the pump 5 has a pair of main surfaces 5*a*, 5*b* which are in a front-and-back relationship each other and are aligned in the Z axis direction. The main surfaces 5*a*, 5*b* are respectively formed of curved surfaces in an arc shape which are curved concentrically around the Y axis in the planar view from the Y axis direction. Further, a radius of curvature of the pump 5 is substantially equal to a radius of curvature of the main body 2. With this configuration, the shape of the pump 5 becomes a curved shape so as to correspond to the curvature of the main body 2. Thus, it is possible to provide the pump 5 in the main body 2 by fitting the pump 5 within an arc-shaped space S in the main body 2 as shown in FIG. 5. Therefore, it is possible to provide the pump 5 in the main body 2 without reducing a size of the pump 5 or increasing a size of the main body 2 unlike the conventional art. In particular, since corners on the main surfaces 5*a*, 5*b* are taken away therefrom by forming the outer shape of the pump 5 in arc shape, it is possible to reduce the size of the pump 5.

The outer shape (the contour shape) of the pump 5 is a substantially rectangular shape having a longitudinal direction in the Y axis direction in the planar view from the X axis direction. Further, the outer shape (the contour shape) of the pump 5 is also a substantially rectangular shape having a longitudinal direction in the Y axis direction in the planar view from the Z axis direction.

The pump 5 includes a case 7 and pump units 9A, 9B respectively provided on both Y axis direction sides of the case 7 as shown in FIG. 3. The pump unit 9A is located in the case 7 on the positive side of the Y axis direction and the pump unit 9B is located in the case 7 on the negative side of the Y axis direction. The outer shape (the contour shape) of the pump 5 is constituted of the case 7 and the pump units 9A, 9B. Components constituting the outer shape of the pump 5 are not particularly limited. For example, the pump units 9A, 9B may be contained in the case 7 and the outer shape of the pump 5 may be substantially constituted of only the case 7.

As shown in FIG. 6, the case 7 includes a box-shaped base 71 having an opening which is open toward the positive side of the Z axis direction and a lid 72 for closing the opening of the box-like base 71. With this configuration, it becomes easier to contain each of the components in the case 7. In particular, it is possible to make the opening of the box-like base 71 larger by forming the opening on the positive side of the Z axis direction, and thereby the above-mentioned effect becomes more remarkable. Further, openings 711 through which after-mentioned pushers 822*a*, 823*a* are respectively passed are respectively formed on both Y-axis direction side surfaces of the base 71. The case 7 protects each of the components contained therein and serves as an electromagnetic shield.

Further, the case 7 contains a vibration actuator 8 and a pair of springs 51A, 51B. The vibration actuator 8 includes a movable body 82 which is movable in the Y axis direction with respect to the case 7 and a coil core portion 85 fixed to the case 7. When the electrical power is supplied to the coil core portion 85, the vibration actuator 8 can allow the movable body 82 to perform reciprocating vibration in the Y axis direction. Since the movable body 82 is configured so as to perform the reciprocating vibration in the Y axis direction, it is possible to suppress a length of the pump 5 in the X axis direction.

The coil core portion 85 includes a bobbin 851 and a pair of coils 852, 853 wound around the bobbin 851. The bobbin 851 has a tubular shape extending in the Y axis direction, and has an arc shape so as to correspond to the outer shape of the case 7. Further, the pair of coils 852, 853 are aligned in the Y axis direction. The coil 852 is located more on the positive side of the Y axis direction than a center of the bobbin 851 and the coil 853 is located more on the negative side of the Y axis direction than the center of the bobbin 851. In the present embodiment, annular concave strips 851*a*, 851*b* are formed on an outer periphery of the bobbin 851. The coil 852 is wound around the concave stripe 851*a*, and the coil 853 is wound around the concave stripe 851*b*. With this configuration, the concave strips 851*a*, 851*b* respectively serve as a positioning portion for the coils 852, 853, and thereby positioning and winding of the coils 852, 853 are facilitated.

The movable body 82 is inserted into the tubular bobbin 851. Further, the movable body 82 is formed in a plate-like shape and in the arc shape so as to correspond to the outer shape of the case 7. The movable body 82 is supported by guides (not shown) so as to be capable of performing the reciprocating vibration in the Y axis direction with respect to the case 7. The movable body 82 includes a magnet 821 and a pair of yokes 822, 823 respectively connected to both Y-axis direction sides of the magnet 821. The yoke 822 is located on the positive side of the magnet 821 in the Y axis direction and the yoke 823 is located on the negative side of the magnet 821 in the Y axis direction. The magnet 821 is a permanent magnet and magnetized in the Y axis direction. In the illustrated aspect, the side of the yoke 822 is an N pole and the side of the yoke 823 is an S pole.

The yoke 822 includes the pusher 822*a* protruding toward the positive side of the Y axis direction (the side of the pump unit 9A). Similarly, the yoke 823 includes the pusher 823*a* protruding toward the negative side of the Y axis direction (the side of the pump unit 9B). The pusher 822*a* protrudes outside the case 7 through one of the openings 711 and is connected to the pump unit 9A. Similarly, the pusher 823*a* protrudes outside the case 7 through the other one of the openings 711 and is connected to the pump unit 9B. When the movable body 82 is displaced toward the positive side of the Y axis direction, the pump unit 9A is pressed by the pusher 822*a*, so that the air is discharged from the pump unit 9A. On the other hand, when the movable body 82 is displaced toward the negative side of the Y axis direction, the pump unit 9B is pressed by the pusher 823*a*, so that the air is discharged from the pump unit 9B.

The spring 51A is located between the movable body 82 and the pump unit 9A. Further, the spring 51A includes a fixing portion 51A1 fixed to the case 7, an engaging portion 51A2 engaged with the yoke 822, and a spring portion 51A3 connecting the fixing portion 51A1 and the engaging portion 51A2. On the other hand, the spring 51B is located between the movable body 82 and the pump unit 9B. The spring 51B includes a fixing portion 51B1 fixed to the case 7, an engaging portion 51B2 engaged with the yokes 823, and a spring portion 51B3 connecting the fixing portion 51B1 and the engaging portion 51B2.

As shown in FIGS. 7 and 8, in a state in which electric power is not supplied to the coil core portion 85 (hereinafter, also referred to as a "natural state"), the movable body 82 is held at a substantially central of the bobbin 851 by elasticity of the springs 51A, 51B located on both sides of the movable body 82. In the natural state, an end portion of the magnet 821 on the positive side of the Y axis direction overlaps with the coil 852 and an end portion of the magnet 821 on the negative side of the Y axis direction overlaps with the coil 853 in the planar view from the Z axis direction.

The pump units 9A, 9B are disposed separately on both sides in the Y axis direction with respect to the case 7 in which the vibration actuator 8 is provided. Specifically, the pump unit 9A is disposed in the case 7 on the positive side of the Y axis direction, and the pump unit 9B is disposed in the case 7 on the negative side of the Y axis direction. As shown in FIGS. 7 and 8, the pump units 9A, 9B have the same configuration as each other, and each of the pump units 9A, 9B has a sealed chamber 91 and a movable wall 92.

The sealed chamber 91 is connected to a suction port 98 for sucking the air from the outside into the sealed chamber 91 and a discharge port 99 for discharging the air in the sealed chamber 91 to the outside. A valve 93 is provided between the sealed chamber 91 and the suction ports 98. The valve 93 allows the air to be suctioned into the sealed chamber 91 through the suction port 98 and prevents the air from being discharged from the sealed chamber 91 through the suction port 98. Further, a valve 94 is provided between the sealed chamber 91 and the discharge port 99. The valve 94 allows the air to be discharged from the sealed chamber 91 through the discharge port 99 and prevents the air from being suctioned into the sealed chamber 91 through the discharge port 99. With this configuration, it is possible to more reliably and more efficiently perform the suction and the discharge of the air.

The movable wall 92 faces an inner surface of the sealed chamber 91 to constitute a part of the sealed chamber 91. The movable wall 92 may be a diaphragm, for example. The movable wall 92 can be formed from elastically deformable material.

In the pump unit 9A, the movable wall 92 constitutes a wall surface of the sealed chamber 91 on the negative side of the Y axis direction. Further, the movable wall 92 of the pump unit 9A is connected to the pusher 822*a* of the yoke 822. When the movable body 82 is displaced toward the positive side of the Y axis direction, the movable wall 92 is pushed and displaced by the pusher 822*a*, so that the volume in the sealed chamber 91 reduces. When the volume in the sealed chamber 91 reduces due to displacement of the movable wall 92, pressure in the sealed chamber 91 increases and thus the air in the sealed chamber 91 is discharged from the discharge port 99. On the other hand, when the movable body 82 is displaced toward the negative side of the Y axis direction, the movable wall 92 is displaced by its own restoring force (elasticity) and the elasticity of the spring 51A, so that the volume in the sealed chamber 91 increases. When the volume in the sealed chamber 91 increases due to the displacement of the movable wall 92, the pressure in the sealed chamber 91 reduces and thus the air flows into the sealed chamber 91 through the suction port 98.

On the other hand, in the pump unit 9B, the movable wall 92 constitutes a wall surface of the sealed chamber 91 on the positive side of the Y axis direction. Further, the movable wall 92 of the pump unit 9B is connected to the pusher 823*a* of the yoke 823. When the movable body 82 is displaced toward the negative side of the Y axis direction, the movable wall 92 is pushed and displaced by the pusher 823*a*, so that the volume in the sealed chamber 91 reduces. When the volume in the sealed chamber 91 reduces due to displacement of the movable wall 92, the pressure in the sealed chamber 91 increases and thus the air in the sealed chamber 91 is discharged from the discharge port 99. On the other hand, when the movable body 82 is displaced toward the positive side of the Y axis direction, the movable wall 92 is displaced by its own restoring force (elasticity) and the elasticity of the spring 51B, so that the volume in the sealed chamber 91 increases. When the volume in the sealed chamber 91 increases due to the displacement of the movable wall 92, the pressure in the sealed chamber 91 reduces and thus the air flows into the sealed chamber 91 through the suction port 98.

Control Device 6

As shown in FIG. 2, the control device 6 has a drive control unit 61 for controlling a drive of the vibration actuator 8 and a pressure detection unit 62 for detecting the pressure in the cuff 3. The control device 6 is composed of a computer or the like. The control device 6 has a processor (CPU) for processing information, a memory communicatively connected to the processor and an external interface. In addition, the memory stores various programs which can be executed by the processor. Further, the processor can read and execute the various programs stored in the memory for providing required functions.

The configuration of the electronic sphygmomanometer 1 has been described. Next, the drive of the pump 5 will be described.

An AC (alternating-current) voltage is applied from the drive control unit 61 to the coils 852, 853 so that a first state shown in FIG. 7 and a second state shown in FIG. 8 are repeated alternately. Thus, the movable body 82 performs the reciprocating vibration in the Y axis direction.

In the first state shown in FIG. 7, thrust Fy1 directed toward the positive side of the Y axis direction is generated, and thereby the movable body 82 is displaced toward the positive side of the Y axis direction. With this movement, the movable wall 92 is pressed by the pusher 822*a* in the pump unit 9A, and thereby the volume in the sealed chamber 91 of the pump unit 9A is reduced. As a result, the air in the sealed chamber 91 of the pump unit 9A is discharged from the discharge port 99. On the other hand, since the volume in the sealed chamber 91 of the pump unit 9B increases, the air flows into the sealed chamber 91 of the pump unit 9B through the suction port 98.

In the second state shown in FIG. 8, thrust Fy2 directed toward the negative side of the Y axis direction is generated, and thereby the movable body 82 is displaced toward the negative side of the Y axis direction. With this movement, the movable wall 92 is pressed by the pusher 823*a* in the pump unit 9B, and thereby the volume in the sealed chamber 91 of the pump unit 9B is reduced. As a result, the air in the sealed chamber 91 of the pump unit 9B is discharged from the discharge port 99. On the other hand, since the volume in the sealed chamber 91 of the pump unit 9A increases, the air flows into the sealed chamber 91 of the pump unit 9A through the suction port 98.

As described above, when each of the pump units 9A, 9B repeatedly alternates between the first state and the second state, it is possible to repeatedly alternate the state in which the air is discharged from the pump unit 9A and the state in which the air is discharged from the pump unit 9B. As a result, the air can be continuously discharged from the pump 5. Thus, the air discharged from the pump 5 is supplied into the cuff 3 to expand the cuff 3. The pressure in the cuff 3 is detected by the pressure detection unit 62 based on an output of the pressure sensor 4.

The drive of the pump 5 has been explained in the above description. Next, a driving principle of the pump 5 will be explained. The vibration actuator 8 of the pump 5 is driven according to a motion equation expressed by the following equation (1) and a circuit equation expressed by the following equation (2).

Equation 1

$$J\frac{d^2\theta(t)}{dt^2} = K_f i(t) - K_{sp}\theta(t) - D\frac{d\theta(t)}{dt} \quad (1)$$

J: Inertial moment [Kg*m$^2$]
θ(t): Displacement angle [rad]
$K_f$: Thrust constant [Nm/A]
i(t): Current [A]
$K_{sp}$: Spring constant [Nm/rad]
D: Damping coefficient [Nm/(rad/s)]

Equation 2

$$e(t) = Ri(t) + L\frac{di(t)}{dt} + K_e\frac{dx(t)}{dt} \quad (2)$$

e(t): Voltage [V]
R: Resistance [Ω]
L: Inductance [H]
$K_e$: Counter-electromotive force constant [V/(rad/s)]

As described above, the inertial moment J [Kg*m$^2$], the displacement angle (rotational angle) θ(t) [rad], the thrust constant $K_f$ [Nm/A], the current i(t) [A], the spring constant $K_{sp}$ [Nm/rad], the damping coefficient D [Nm/(rad/s)] and the like of the movable body 82 can be appropriately set as long as they satisfy the equation (1). Similarly, the voltage e(t) [V], the resistance R [Ω], the inductance L [H] and the counter-electromotive force constant $K_e$ [V/(rad/s)] can be appropriately set as long as they satisfy the equation (2).

Further, a flow rate of the pump 5 is determined by the following equation (3) and pressure of the pump 5 is determined by the following equation (4).

Equation 3

$$Q=Axf*60 \quad (3)$$

Q: Flow rate [L/min]
A: Piston area [$m_2$]
x: Piston displacement [m]
f: Drive frequency [Hz]

Equation 4

$$P = P_0\left(\frac{V+\Delta V}{V-\Delta V} - 1\right) \quad (4)$$

P: Increased pressure [kPa]
$P_0$: Atmospheric pressure [kPa]
V: Sealed chamber volume [m$^3$]
ΔV: Changed volume [m$^3$]
ΔV=Ax
A: Piston area [m$^2$]
x: Piston displacement [m]

As described above, the flow rate Q [L/min], the piston area A [m$^2$], the piston displacement x [m], the drive frequency f [Hz] and the like of the pump 5 can be appropriately set as long as they satisfy the equation (3). Similarly, the increased pressure P [kPa], the atmospheric pressure $P_0$ [kPa], the sealed chamber volume V [m$^3$], the changed volume ΔV [m$^3$] and the like can be appropriately set as long as they satisfy the equation (4).

Next, a resonance frequency of the vibration actuator 8 of the pump 5 will be explained. The vibration actuator 8 has a spring mass system structure for supporting the movable body 82 by a magnetic spring formed by the magnetic force acting between the coil core portion 85 and the magnet 821, physical springs respectively formed by the elasticity of the spring 51A, 51B, and air spring (fluid springs) formed by elastic force of compressed air in the sealed chambers 91. Thus, the movable body 82 has a resonant frequency $f_r$ expressed by the following equation (5). By applying an AC voltage whose frequency is substantially equal to the resonance frequency $f_r$ to the coils 852, 853 of the pump 5, it is possible to allow the movable body 82 of the pump 5 to perform resonance drive, thereby efficiently driving of the pump 5.

Equation 5

$$f_r = \frac{1}{2\pi}\sqrt{\frac{K_{sp}}{J}} \quad (5)$$

$f_r$: Resonance frequency [Hz]
$K_{sp}$: Spring constant [Nm/rad]
J: Inertial moment [kg*m$^2$]

Second Embodiment

Figure 9:
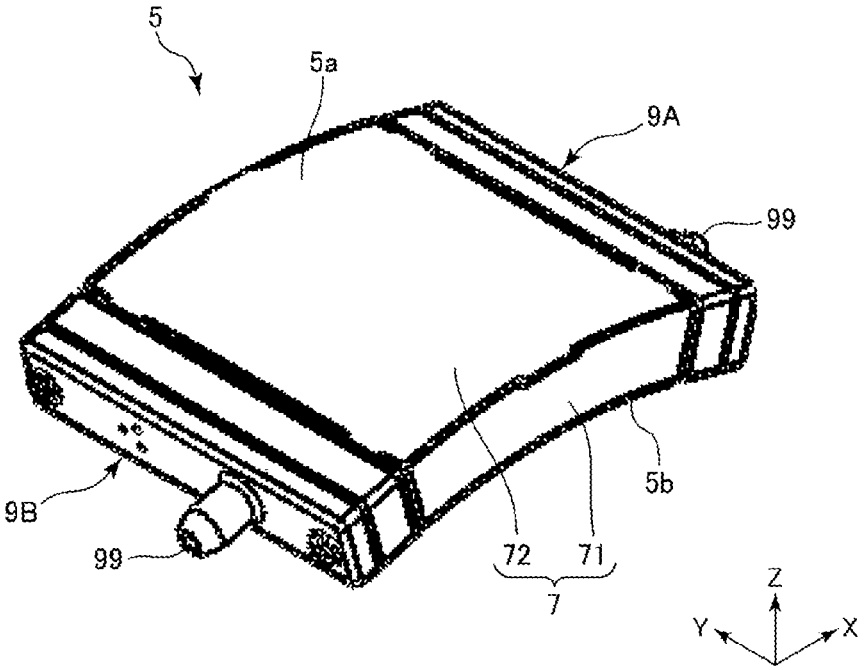
FIG. 9 is a perspective view showing a pump according to a second embodiment of the present disclosure.
Figure 10:
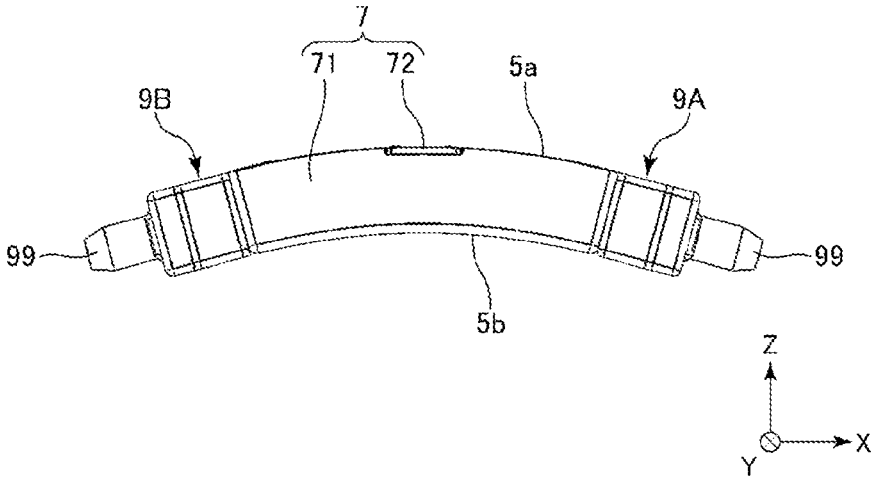
FIG. 10 is a planar view of the pump according to the second embodiment of the present disclosure viewed from the Y axis direction.
Figure 11:
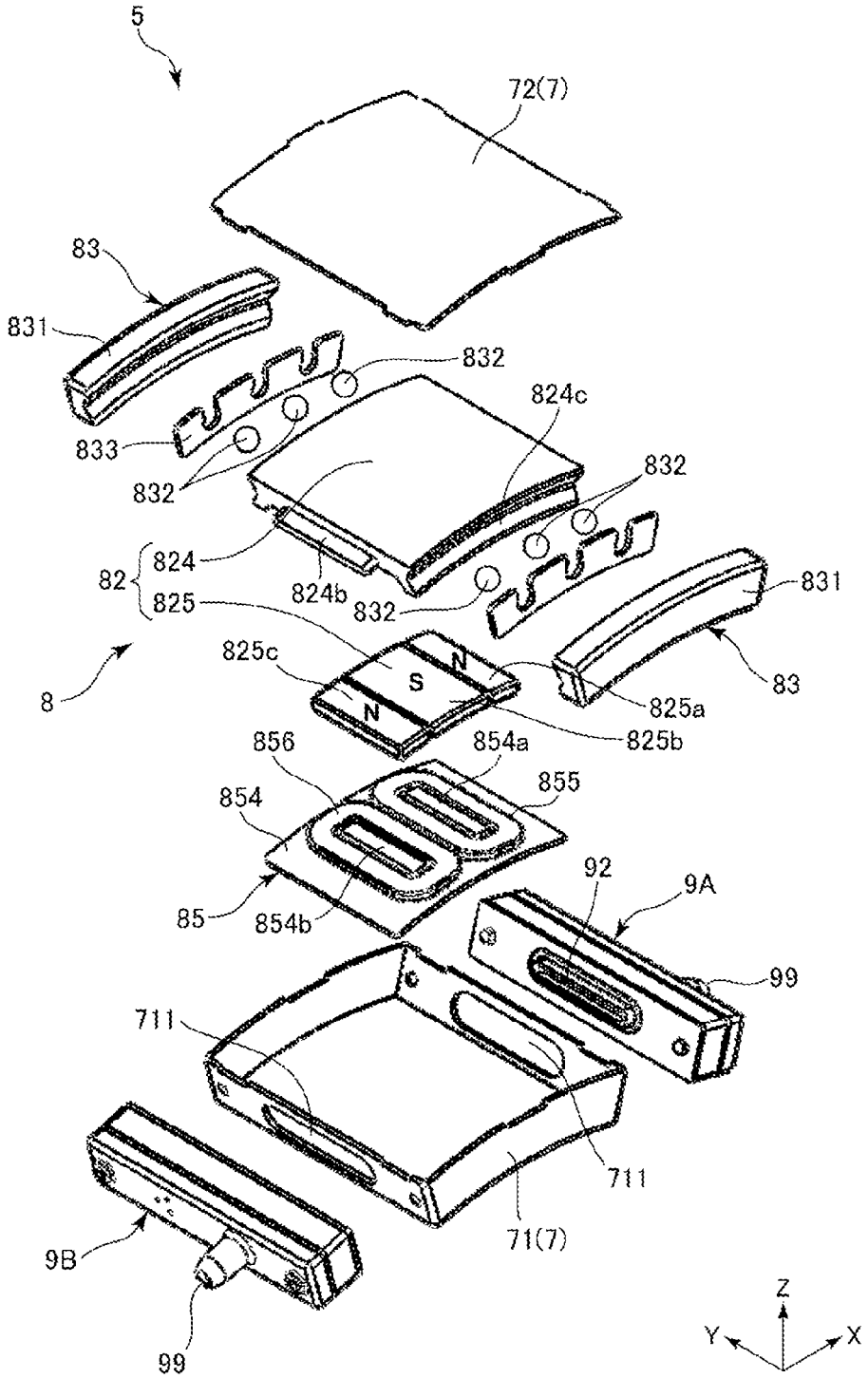
FIG. 11 is an exploded perspective view of the pump according to the second embodiment of the present disclosure.
Figure 12:
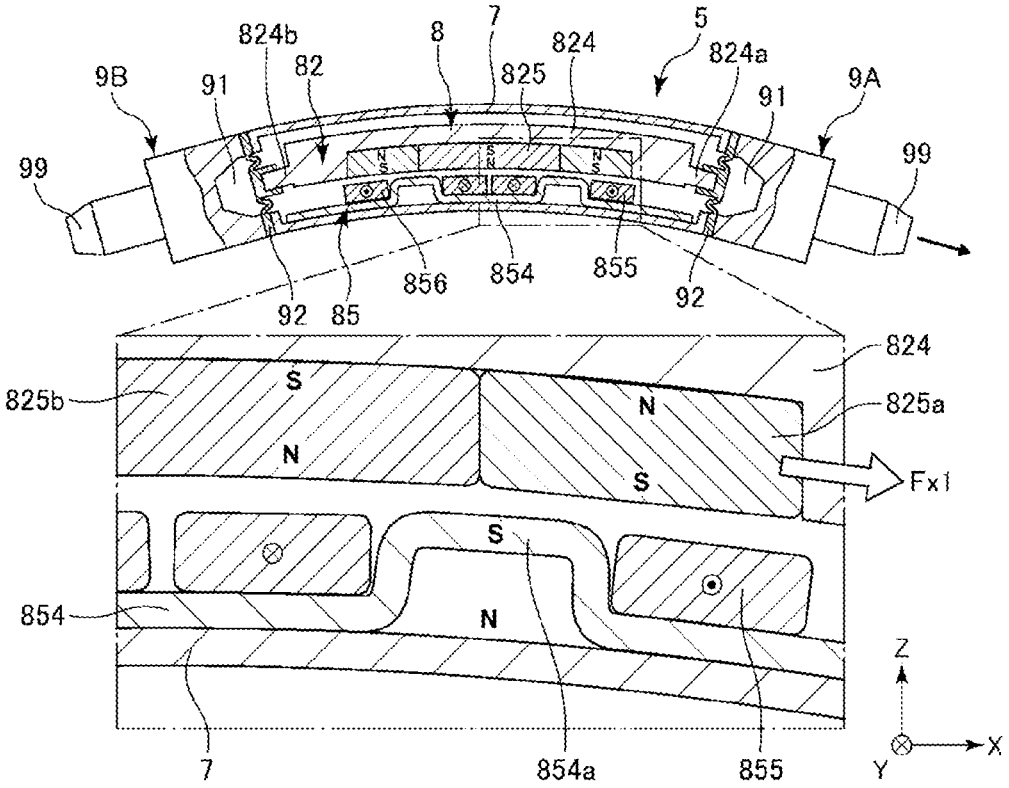
FIG. 12 is a cross-sectional view showing a driving state of the pump according to the second embodiment of the present disclosure.
Figure 13:
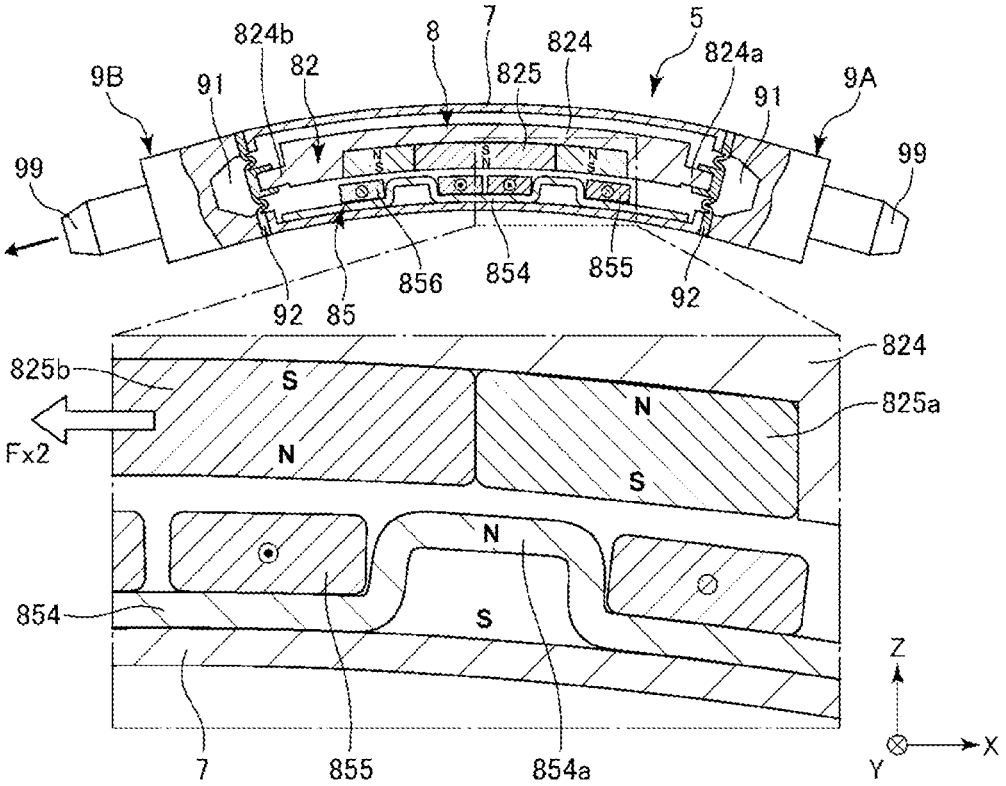
FIG. 13 is another cross-sectional view showing another driving state of the pump according to the second embodiment of the present disclosure.

FIG. 9 is a perspective view showing a pump according to a second embodiment of the present disclosure. FIG. 10 is a planar view of the pump viewed from the Y axis direction. FIG. 11 is an exploded perspective view of the pump. FIG. 12 is a cross-sectional view showing a driving state of the pump. FIG. 13 is another cross-sectional view showing the driving state of the pump.

A pump 5 of the present embodiment mainly has the same configuration as the configuration of the pump 5 of the first embodiment described above except that a vibration direction of the movable body 82 is modified. Thus, in the following description, the present embodiment will be described by placing emphasis on the points differing from the first embodiment described above with the same matters being omitted from the description. In FIGS. 9 to 13, the same reference numbers are assigned to the same components as the components of the above-described embodiment.

Pump 5

The outer shape (the contour shape) of the pump 5 is a flat plate-like shape and an arc shape curved in a substantially arc shape around the Y axis in the planar view from the Y axis direction as shown in FIGS. 9 and 10. The pump 5 includes a case 7 and the pair of pump units 9A, 9B respectively provided on both x-axis direction sides of the case 7. The pump unit 9A is located in the case 7 on the positive side of the X axis direction and the pump unit 9B is located in the case 7 on the negative side of the X axis direction. The outer shape (the contour shape) of the pump 5 is constituted of the case 7 and the pump units 9A, 9B. Components constituting the outer shape of the pump 5 are not particularly limited.

Further, the case 7 contains the vibration actuator 8 therein as shown in FIG. 11. The vibration actuator 8 includes the movable body 82 which is movable in the X axis direction with respect to the case 7, guides 83 for guiding the movable body 82, and the coil core portion 85 fixed to the case 7. When the electrical power is supplied to the coil core portion 85 in the vibration actuator 8, the movable body 82 can rotate (so as to draw an arc) around Y axis along an arc of the case 7 to perform reciprocating vibration in the X axis direction. Since the movable body 82 is configured so as to perform the reciprocating vibration in the X axis direction, it is possible to suppress a length of the pump 5 in the Y axis direction.

The coil core portion 85 includes a core 854 and a pair of coils 855, 856 wound around the core 854. The core 854 has a flat plate-like shape and is curved in an arc shape corresponding to the outer shape of the case 7. Further, the core 854 is fixed on an inner bottom surface of the case 7. The core 854 includes a pair of protruding portions 854*a*, 854*b* protruding toward the positive side of the Z axis direction. Each of the protruding portions 854*a*, 854*b* has a longitudinal shape extending in the Y axis direction and is arranged side by side in the X axis direction. The coil 855 is wound around the protruding portion 854*a*, and the coil 856 is wound around the protruding portion 854*b*.

The movable body 82 is disposed above the coil core portion 85 so as to cover the coil core portion 85. The movable body 82 has a flat plate-like shape and has an arc shape corresponding to the case 7. Further, the movable body 82 includes a yoke 824 and a magnet 825 fixed to the yoke 824. The magnet 825 has three magnets 825*a*, 825*b*, 825*c* arranged side by side in the X axis direction. Each of the magnets 825*a*, 825*b*, 825*c* is a permanent magnet and magnetized in the Z axis direction. In the illustrated aspect, the magnet 825*b* located at the center among the three magnets has the S pole on the positive side of the Z axis direction and the N pole on the negative side of the Z axis direction. On the other hand, each of the magnets 825*a*, 825*c* located at both end sides among the three magnets has the N pole on the positive side of the Z axis direction and the S pole on the negative side of the Z axis direction. That is, the S poles and the N poles are alternately arranged along the X axis direction on a lower surface of the magnet 825 (a magnetic pole surface facing the coil core portion 85). In an initial state, a boundary between the magnets 825*a*, 825*b* is located on the protruding portion 854*a*, and a boundary between the magnets 825*b*, 825*c* is located on the protruding portion 854*b*.

The yoke 824 covers the magnet 825 the magnet 825 the upper side. As shown in FIGS. 12 and 13, the yoke 824 includes a concave portion formed on its lower surface so as to open toward the lower side. The magnet 825 is contained in the concave portion of the yoke 824. The yoke 824 further includes a pusher 824*a* protruding toward the positive side of the X axis direction of the magnet 821 and a pusher 824*b* protruding toward the negative side of the X axis direction of the magnet 821. When the movable body 82 is displaced toward the positive side of the X axis direction, the pump unit 9A is pressed by the pusher 824*a* to discharge the air from the pump unit 9A. On the contrary, when the movable body 82 is displaced toward the negative side of the X axis direction, the pump unit 9B is pressed by the pusher 824*b* to discharge air from the pump unit 9B.

The pump units 9A, 9B are disposed separately on both X axis direction sides with respect to the case 7 in which the vibration actuator 8 is provided. Specifically, the pump unit 9A is disposed in the case 7 on the positive side of the X axis direction, and the pump unit 9B is disposed in the case 7 on the negative side of the X axis direction. The pump units 9A, 9B have the same configuration as each other.

The guides 83 are respectively disposed on both Y axis direction sides of the movable body 82. Each of the guides 83 includes a rail 831 fixed to the case 7, a plurality of balls 832 arranged side by side in the X axis direction between the rail 831 and the movable body 82 (the yoke 824), and a holder 833 for holding each ball 832 so as to be rotatably with respect to the rail 831. Grooves 824*c* are respectively formed on both Y axis direction side surfaces of the yoke 824, and the plurality of balls 832 are respectively engaged with the grooves 824*c*.

An AC (alternating-current) voltage is applied from the drive control unit 61 to the coils 852, 853 so that a first state shown in FIG. 12 and a second state shown in FIG. 13 are repeated alternately. As a result, the movable body 82 performs reciprocating vibration in the X axis direction.

In the first state shown in FIG. 12, thrust Fx1 directed toward the positive side of the X axis direction is generated, and thereby the movable body 82 is displaced toward the positive side of the X axis direction. With this movement, the movable wall 92 is pressed by the pusher 824*a* in the pump unit 9A, and thereby the volume in the sealed chamber 91 of the pump unit 9A is reduced. As a result, the air in the sealed chamber 91 of the pump unit 9A is discharged from the discharge port 99. On the other hand, since the volume in the sealed chamber 91 of the pump unit 9B increases, the air flows into the sealed chamber 91 of the pump unit 9B through the suction port 98.

In the second state shown in FIG. 13, thrust Fx2 directed toward the negative side of the X axis direction is generated, and thereby the movable body 82 is displaced toward the negative side of the X axis direction. With this movement, the movable wall 92 is pressed by the pusher 824*b* in the pump unit 9B, and thereby the volume in the sealed chamber 91 of the pump unit 9B is reduced. As a result, the air in the sealed chamber 91 of the pump unit 9B is discharged from the discharge port 99. On the other hand, since the volume in the sealed chamber 91 of the pump unit 9A increases, the air flows into the sealed chamber 91 of the pump unit 9A through the suction port 98.

As described above, when each of the pump units 9A, 9B repeatedly alternates between the first state and the second state, it is possible to repeatedly alternate the state in which the air is discharged from the pump unit 9A and the state in which the air is discharged from the pump unit 9B. As a result, the air can be continuously discharged from the pump 5.

Third Embodiment

Figure 14:
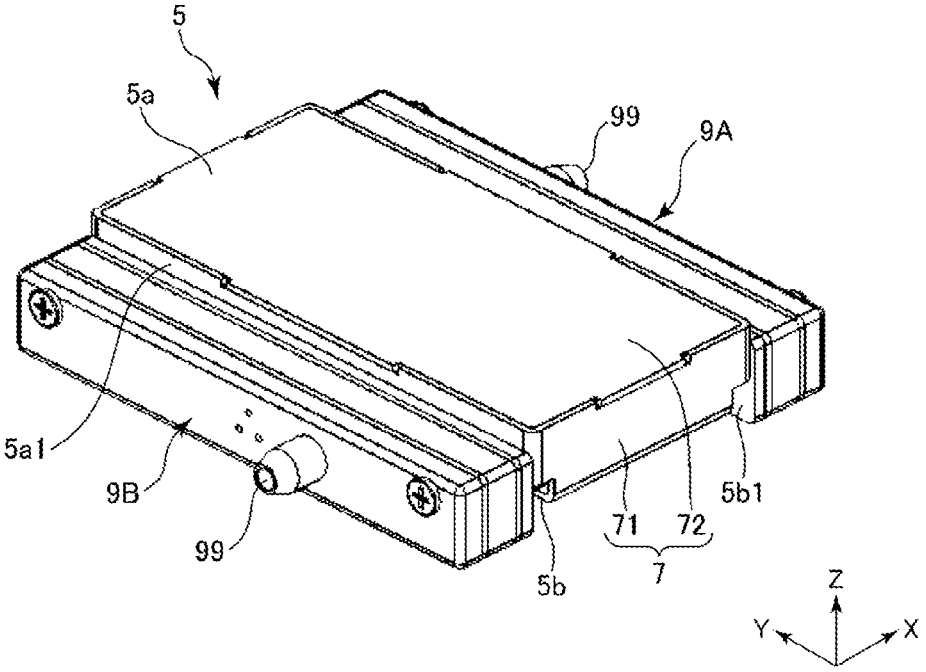
FIG. 14 is a perspective view showing a pump according to a third embodiment of the present disclosure.
Figure 15:
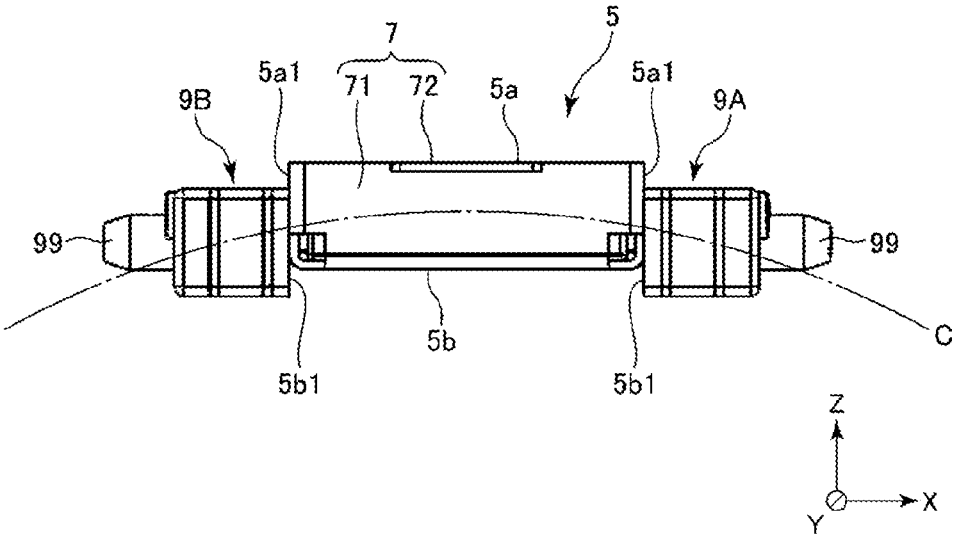
FIG. 15 is a planar view of the pump viewed from the Y axis direction according to the third embodiment of the present disclosure.
Figure 16:
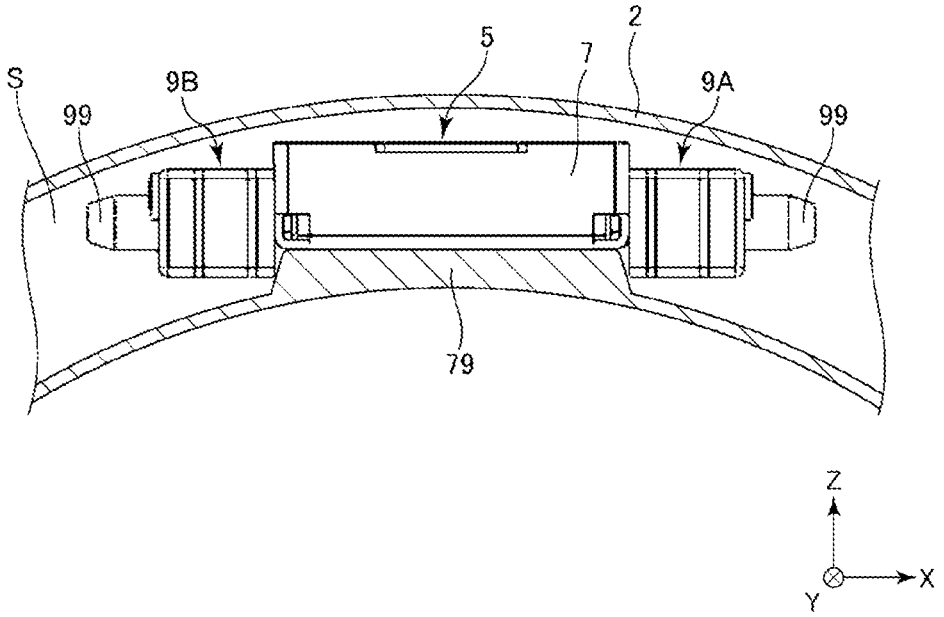
FIG. 16 is a cross-sectional view showing a state in which the pump according to the third embodiment of the present disclosure is provided in the electronic sphygmomanometer.
Figure 17:
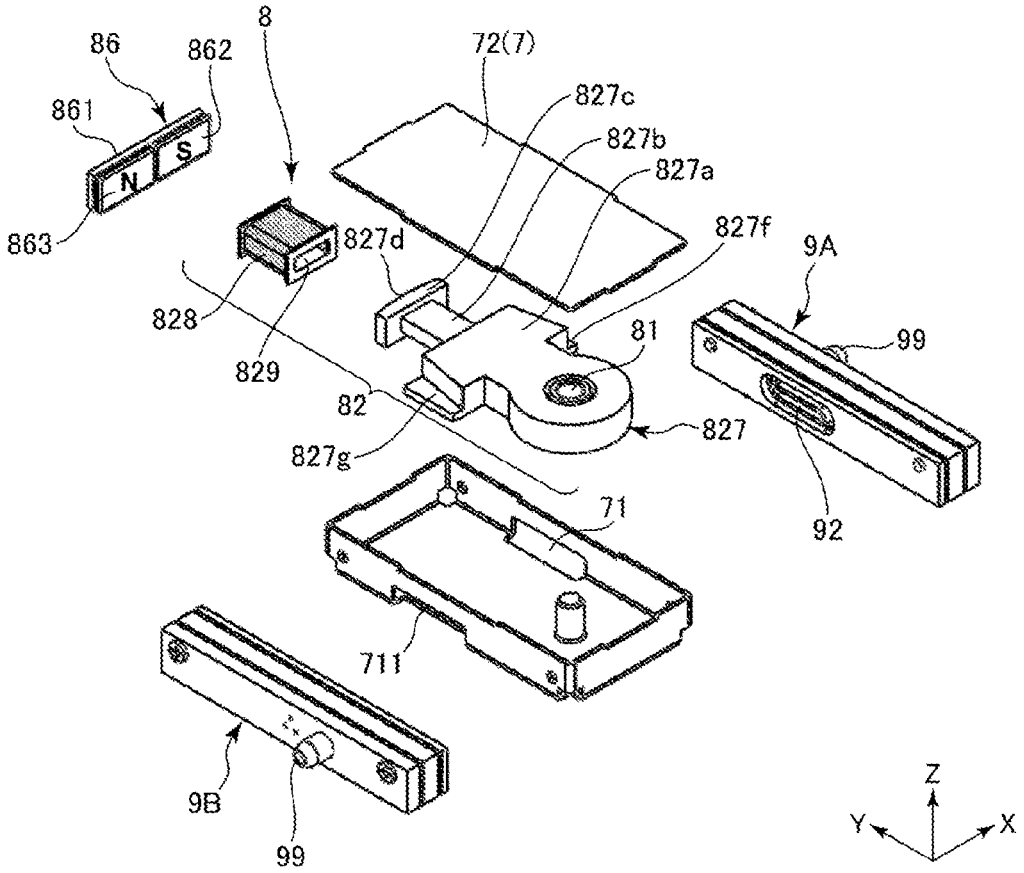
FIG. 17 is an exploded perspective view of the pump according to the third embodiment of the present disclosure.
Figure 18:
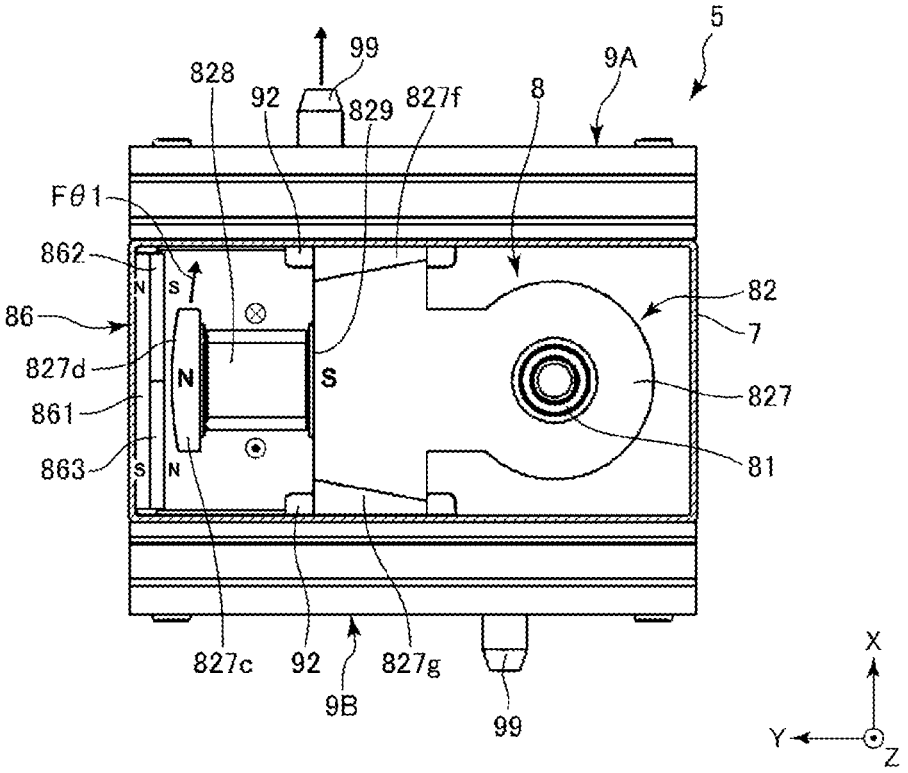
FIG. 18 is a cross-sectional view showing a driving state of the pump according to the third embodiment of the present disclosure.
Figure 19:
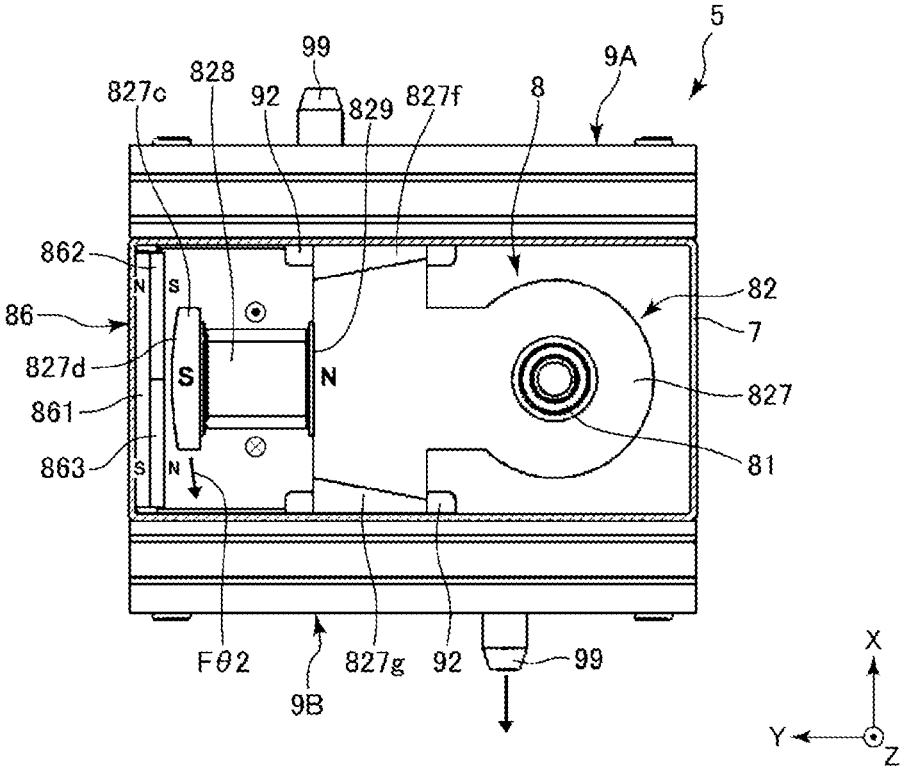
FIG. 19 is another cross-sectional view showing another driving state of the pump according to the third embodiment of the present disclosure.

FIG. 14 is a perspective view showing a pump according to a third embodiment of the present disclosure. FIG. 15 is a planar view of the pump viewed from the Y axis direction. FIG. 16 is a cross-sectional view showing a state in which the pump is provided in the electronic sphygmomanometer. FIG. 17 is an exploded perspective view of the pump. FIG. 18 is a cross-sectional view showing a driving state of the pump. FIG. 19 is another cross-sectional view showing another driving state of the pump.

A pump 5 of the present embodiment mainly has the same configuration as the configuration of the pump 5 of the first embodiment described above except that the outer shape (the contour shape) of the pump 5 is modified. Thus, in the following description, the present embodiment will be described by placing emphasis on the points differing from the embodiments described above with the same matters being omitted from the description. In FIGS. 14 to 19, the same reference numbers are assigned to the same components as the components of the above-described embodiments.

Pump 5

The outer shape (the contour shape) of the pump 5 is a flat plate-like shape and a stepped shape having steps between a central portion of the pump 5 in the X axis direction and each of end portions located on both sides of the pump 5 in the planar view from the Y axis direction as shown in FIGS. 14 and 15. The pump 5 includes a case 7 and the pair of pump units 9A, 9B respectively provided on both X axis direction sides of the case 7. The pump unit 9A is located in the case 7 on the positive side of the X axis direction and the pump unit 9B is located in the case 7 on the negative side of the X axis direction. The outer shape (the contour shape) of the pump 5 is constituted of the case 7 and the pump units 9A, 9B. Components constituting the outer shape (the contour shape) of the pump 5 are not particularly limited.

Further, when the Z axis direction is defined as the thickness direction of the case 7, the case 7 has a flat plate-like shape extending in the X-Y plane. Further, the case 7 is disposed so as to be shifted toward the positive side of the Z axis direction with respect to the pump units 9A, 9B. With this configuration, a stepped surface is formed between the case 7 constituting the central portion and each of the pump units 9A, 9B constituting the end portions. Specifically, a stepped surface 5*a*1 facing toward the X axis direction is formed between the case 7 and each of the pump units 9A, 9B on the main surface 5*a* of the pump 5. Similarly, a stepped surface 5*b*1 facing toward the X axis direction is formed between the case 7 and each of the pump units 9A, 9B on the main surface 5*b*.

As shown in FIG. 15, the case 7 is formed along an arc C which has a substantially equal radius of curvature to the radius of curvature of the body 2. With this configuration, the pump 5 is formed in the stepped shape so as to correspond to the curvature of the main body 2. As a result, it is possible to provide the pump 5 so as to fit within the arc-shaped space S in the main body 2 as shown in FIG. 16. Thus, it is possible to provide the pump 5 in the main body 2 without reducing the size of the pump 5 and increasing the size of the main body 2 unlike the conventional art. In particular, by forming the outer shape in the stepped shape, for example, it is possible to engage the step with a protrusion 79 formed in the case 7 as shown in FIG. 16. As a result, it is possible to easily position the pump 5 with respect to the case 7. Further, since there is no need to bend each portion, it is also possible to reduce the cost of the pump 5.

Further, the case 7 contains the vibration actuator 8 therein as shown in FIG. 17. The vibration actuator 8 includes a shaft portion 81, a movable body 82 supported by the shaft portion 81 so as to be movable around the Z axis with respect to the housing 7 and a magnet portion 86 fixed to the housing 7. When the electrical power is supplied to the movable body 82 in the vibration actuator 8, the movable body 82 can perform reciprocating vibration around the Z axis. Since the movable body 82 is configured so as to perform the reciprocating vibration around the Z axis, for example, there is no need of any guide for guiding the movable body 82 unlike the first embodiment and the second embodiment described above. Thus, it is possible to reduce the size and the cost of the pump 5.

The movable body 82 includes a yoke 827 connected to the shaft portion 81 and a coil 828 wound around the yoke 827. The coil 828 is provided on the yoke 827 with being wound around a tubular bobbin 829. However, the present disclosure is not limited thereto. For example, the bobbin 829 may be omitted and the coil 828 may be directly wound around the yoke 827.

The yoke 827 is connected to the shaft portion 81 at an end portion on the negative side of the Y axis direction. The yoke 827 includes a base portion 827*a* connected to the shaft portion 81, a rod-shaped insertion portion 827*b* which protrudes from the base portion 827*a* toward the positive side of the Y axis direction and into which the bobbin 829 is inserted, and a magnetic pole portion 827*c* which is connected to a tip end portion of the insertion portion 827*b* and whose width is wider than a width of the insertion portion 827*b*. The magnetic pole portion 827*c* includes a magnetic pole surface 827*d* which has an arc shape in the planar view from the Z axis direction. When electric power is supplied to the coil 828, the magnetic pole surface 827*d* is excited.

Further, the yoke 827 includes a pusher 827*f* protruding toward the positive side of the X axis direction and a pusher 827*g* protruding toward the negative side of the X axis direction. When the movable body 82 is displaced toward the positive side of the X axis direction around the Z axis, the pump unit 9A is pressed by the pusher 827*f* to discharge the air from the pump unit 9A. On the contrary, when the movable body 82 is displaced toward the negative side of the X axis direction around the Z axis, the pump unit 9B is pressed by the pusher 827*g* to discharge the air from the pump unit 9B.

The magnet portion 86 is located on the positive side of the Y axis direction of the yoke 827 and disposed so as to face the magnet pole surface 827*d* of the yoke 827. The magnet portion 86 includes a core portion 861 and a pair of magnets 862, 863 provided on the core portion 861. The core portion 861 has a flat plate-like shape and is fixed on an inner surface of the case 7 on the positive side of the Y axis direction. The magnets 862, 863 are provided on the core portion 861 and arranged side by side in the X axis direction. Further, the magnets 862, 863 are magnetized so that magnetization directions of the magnets 862, 863 are respectively directed in opposite directions of the Y axis direction. In the illustrated aspect, the magnet 862 has the S pole on the side of the magnetic pole surface 827*d* and the N pole on the opposite side of the magnetic pole surface 827*d*. On the other hand, the magnet 863 has the N pole on the side of the magnetic pole surface 827*d* and the S pole on the opposite side of the magnetic pole surface 827*d*.

The pump units 9A, 9B are disposed separately on both X axis direction sides with respect to the case 7 in which the vibration actuator 8 is provided. Specifically, the pump unit 9A is disposed in the case 7 on the positive side of the X axis direction and the pump unit 9B is disposed in the case 7 on the negative side of the X axis direction. The pump units 9A, 9B have the same configuration as each other.

An AC (alternating-current) voltage is applied from the drive control unit 61 to the coils 828 so that a first state shown in FIG. 18 and a second state shown in FIG. 19 are repeated alternately. Thus, the movable body 82 performs reciprocating vibration around the Z axis.

In the first state shown in FIG. 18, thrust Fθ1 around the Z axis and directed toward the positive side of the X axis direction is generated, and thereby the movable body 82 is displaced toward the positive side of the X axis direction. With this movement, the movable wall 92 is pressed by the pusher 827*f* in the pump unit 9A, and thereby the volume in the sealed chamber 91 of the pump unit 9A is reduced. As a result, the air in the sealed chamber 91 of the pump unit 9A is discharged from the discharge port 99. On the other hand, since the volume in the sealed chamber 91 of the pump unit 9B increases, the air flows into the sealed chamber 91 of the pump unit 9B through the suction port 98.

In the second state shown in FIG. 19, thrust Fθ2 around the Z axis and directed toward the negative side of the X axis direction is generated, and thereby the movable body 82 is displaced toward the negative side of the X axis direction. With this movement, the movable wall 92 is pressed by the pusher 827*g* in the pump unit 9B, and thereby the volume in the sealed chamber 91 of the pump unit 9B is reduced. As a result, the air in the sealed chamber 91 of the pump unit 9B is discharged from the discharge port 99. On the other hand, since the volume in the sealed chamber 91 of the pump unit 9A increases, the air flows into the sealed chamber 91 of the pump unit 9A through the suction port 98.

As described above, when each of the pump units 9A, 9B repeatedly alternates between the first state and the second state, it is possible to repeatedly alternate the state in which the air is discharged from the pump unit 9A and the state in which the air is discharged from the pump unit 9B. Thus, the air can be continuously discharged from the pump 5. As this result, the air discharged from the pump 5 is supplied into the cuff 3 to expand the cuff 3.

Fourth Embodiment

Figure 20:
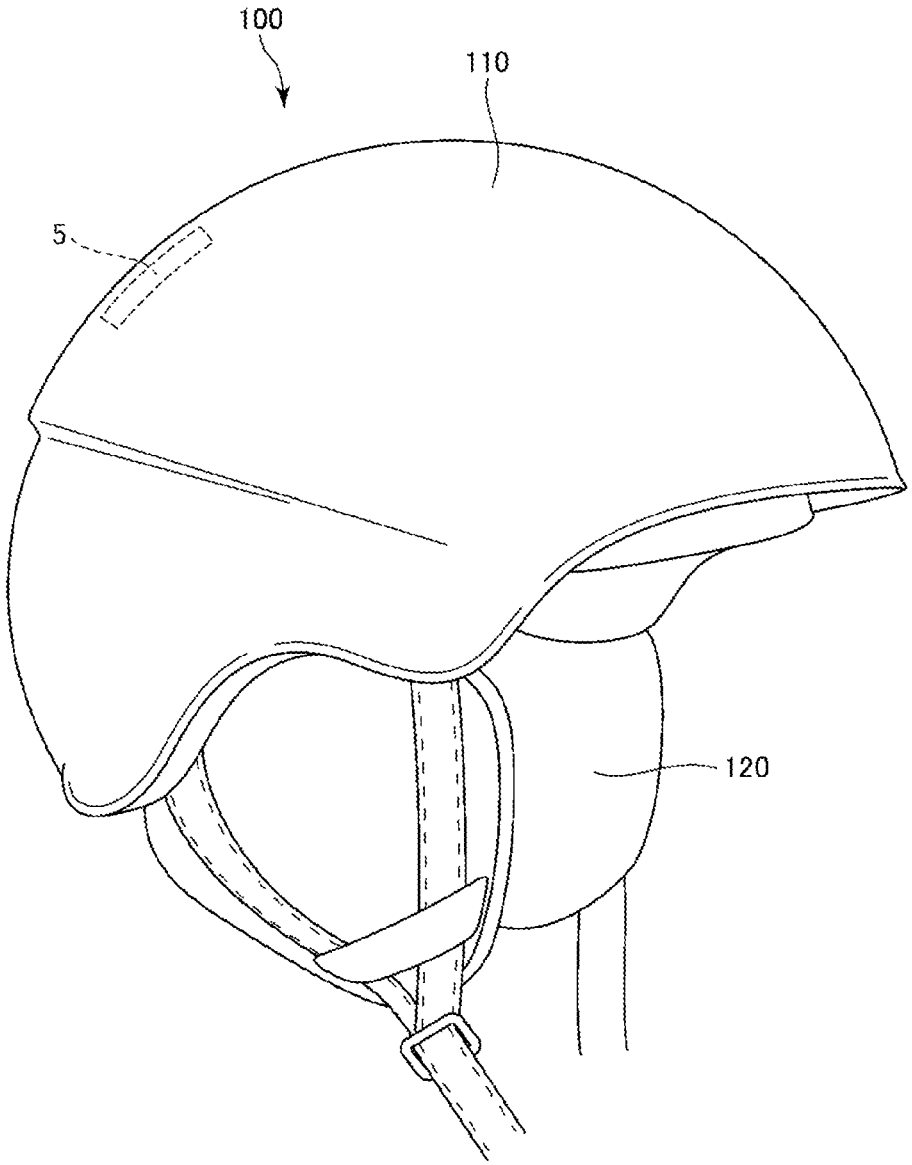
FIG. 20 is a perspective view showing a helmet according to a fourth embodiment of the present disclosure.
Figure 21:
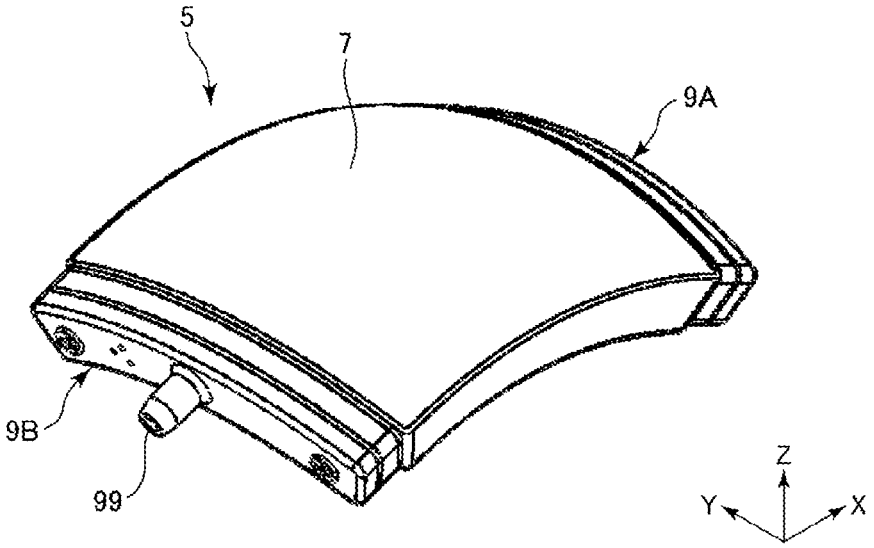
FIG. 21 is a perspective view showing the pump provided in the helmet according to the fourth embodiment of the present disclosure.
Figure 22:
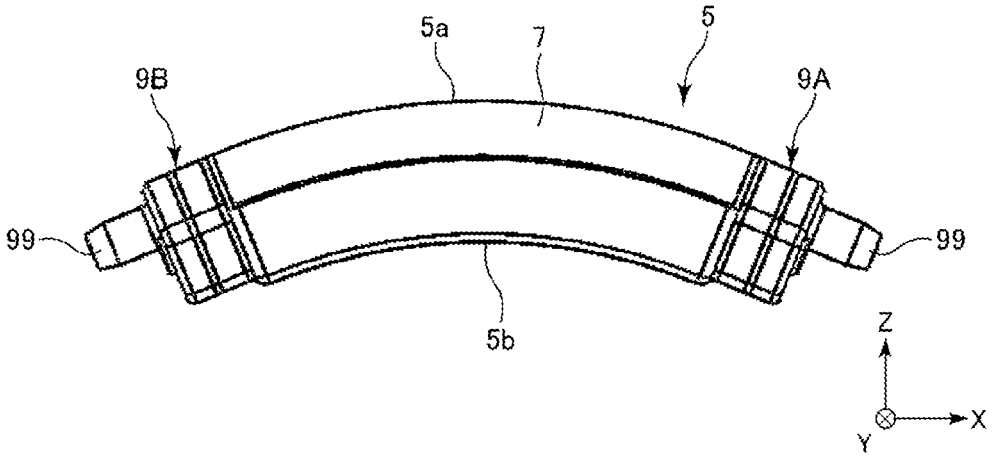
FIG. 22 is a planar view of the pump according to the fourth embodiment of the present disclosure viewed from the Y axis direction.
Figure 23:
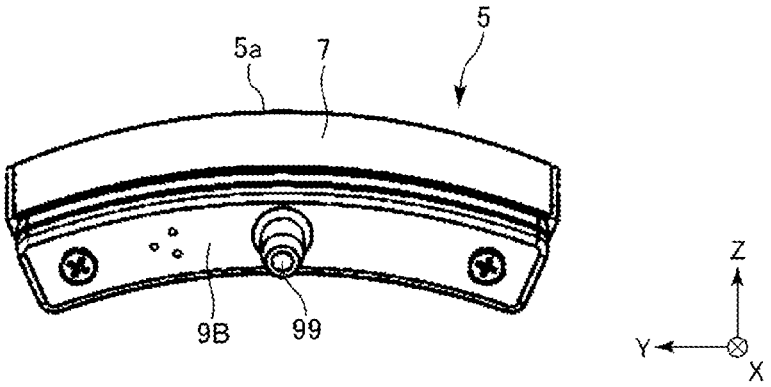
FIG. 23 is a planar view of the pump according to the fourth embodiment of the present disclosure viewed from the X axis direction.
Figure 24:
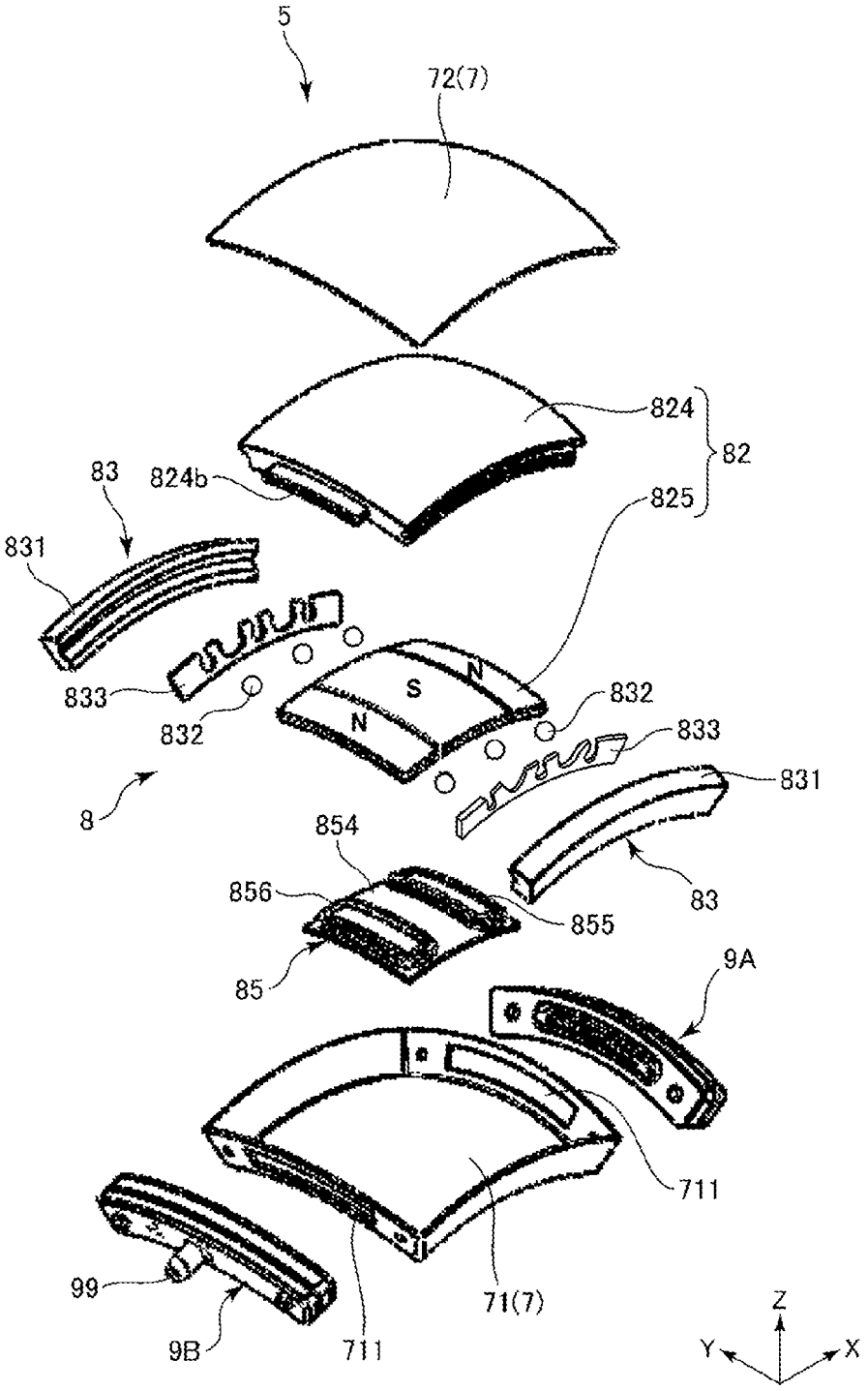
FIG. 24 is an exploded perspective view of the pump according to the fourth embodiment of the present disclosure.

FIG. 20 is a perspective view showing a helmet according to a fourth embodiment of the present disclosure. FIG. 21 is a perspective view showing the pump provided in the helmet. FIG. 22 is a planar view of the pump viewed from the Y axis direction. FIG. 23 is a planar view of the pump viewed from the X axis direction. FIG. 24 is an exploded perspective view of the pump.

A pump 5 of the present embodiment mainly has the same configuration as the configuration of the pump 5 of the second embodiment described above except that the outer shape of the pump 5 is modified. Thus, in the following description, the present embodiment will be described by placing emphasis on the points differing from the embodiments described above with the same matters being omitted from the description. In FIGS. 20 to 24, the same reference numbers are assigned to the same components as the components of the above-described embodiments.

FIG. 20 shows a helmet 100 serving as a fluid supply device. The helmet 100 includes a hard shell portion 110 having a curved shape along a shape of a human head and a soft inner 120 provided inside the shell portion 110. The pump 5 is provided in the shell portion 110. Further, the inner 120 includes a bladder (not shown). With this configuration, it is possible to fit the inner 120 with the shape of the human head by inflating the bladder with air supplied from the pump 5.

Pump 5

As shown in FIG. 21, the outer shape of the pump 5 is a dome-shaped concave shape. Specifically, as shown in FIGS. 22 and 23, the outer shape of the pump 5 has a concave shape in the planar view from the Y axis direction and is curved in an arc shape around the Y axis. Further, the outer shape of the pump 5 is a concave shape even in a planar view from the X axis direction and curved in an arc shape around the X axis. With this configuration, the pump 5 is curved so as to correspond to the curvature of the shell portion 110. As a result, it is possible to provide the pump 5 in the shell 110 so as to fit the shape of the shell 110. Thus, it is possible to provide the pump 5 in the shell 110 without reducing the size of the pump 5 and increasing the size of the main body 2 unlike the conventional art.

The configuration of each of the pump units 9A, 9B and the vibration actuator 8 of the fourth embodiment is the same as the configuration of each of the pump units 9A, 9B and the vibration actuator 8 of the second embodiment described above, except that they are curved not only around Y axis but also around the X axis. Thus, description for the same matters will be omitted.

Although the pump and the fluid supply device of the present disclosure have been described with reference to the illustrated embodiments, the present disclosure is not limited thereto. The configuration of each part can be replaced with any configuration having a similar function. Further, other optional component(s) may also be added to the present disclosure. Further, although the electronic sphygmomanometer and the helmet have been described as examples of the fluid supply device in the above-described embodiments, the present disclosure is not particularly limited to any wearable terminal or any other machine or instrument as long as the fluid supply device into which the fluid need to be supplied.

The invention claimed is:

1. A pump, comprising:

a sealed chamber;

a movable wall for changing a volume of the sealed chamber;

a vibration actuator which can be electromagnetically driven for displacing the movable wall to discharge fluid in the sealed chamber to an outside of the sealed chamber; and a case containing the vibration actuator therein, wherein the vibration actuator includes a movable body which is movable with respect to the case and has a magnet, and a coil core portion fixed to the case, wherein three axes perpendicular to each other are respectively defined as an X axis, a Y axis, and a Z axis, wherein, when a direction along the X axis is defined as an X axis direction, a direction along the Y axis is defined as a Y axis direction, and a direction along the Z axis is defined as a Z axis direction, an outer shape of the case is an arc shape in a planar view from the Y axis direction, wherein the movable body has an arc shape corresponding to the outer shape of the case, wherein the coil core portion includes a pair of coils, a plate-like core curved in an arc shape corresponding to the outer shape of the case, and a pair of protruding portions which protrude from the core toward the Z axis direction and around which the pair of coils are respectively wound, wherein the case has an arc-shaped upper plate and an arc-shaped bottom plate facing the arc-shaped upper plate, wherein the core has an arc-shaped upper surface facing the upper plate of the case and an arc-shaped lower surface fixed on an inner surface of the bottom plate of the case, and wherein the pair of protruding portions are provided on the upper surface of the core so as to be spaced apart from each other.

2. The pump as claimed in claim 1, wherein the movable body can perform reciprocating vibration in the X axis direction to displace the movable wall.

3. The pump as claimed in claim 1, wherein the outer shape of the case is a concave shape curved in a substantially arc shape around the Y in a planar view from the Y axis direction.

4. A fluid supply device, comprising:

the pump defined by claim 1, and a cuff.

5. The fluid supply device as claimed in claim 4, wherein the fluid supply device is attachable to a curved shape portion of a human body.

* * * * *